US007699686B2

(12) United States Patent
Hahn et al.

(10) Patent No.: US 7,699,686 B2
(45) Date of Patent: Apr. 20, 2010

(54) METHOD FOR POLISHING AND ALUMINUM-ZINC HOT-DIP COATING

(75) Inventors: Henry N. Hahn, Valparaiso, IN (US); Ronald J. Dutton, Annapolis, MD (US); Larry F. Crawford, Columbus, OH (US)

(73) Assignee: Severstal Sparrows Point, LLC, Sparrows Point, MD (US)

( * ) Notice: Subject to any disclaimer, the term of this patent is extended or adjusted under 35 U.S.C. 154(b) by 84 days.

(21) Appl. No.: 11/592,856

(22) Filed: Nov. 3, 2006

(65) Prior Publication Data

US 2008/0107915 A1 May 8, 2008

(51) Int. Cl.
*B24B 1/00* (2006.01)

(52) U.S. Cl. ..... 451/28; 451/41; 451/285

(58) Field of Classification Search ..... 451/28, 451/41, 285–290; 428/626, 659, 681, 687
See application file for complete search history.

(56) References Cited

U.S. PATENT DOCUMENTS 4,243,730 A 1/1981 Nakayama et al.
4,374,902 A * 2/1983 Smith et al. ..... 428/621
5,263,773 A 11/1993 Gable et al.
5,552,235 A * 9/1996 Bastawros et al. ..... 428/687
6,235,409 B1 * 5/2001 Serafin et al. ..... 428/654
6,261,702 B1 7/2001 McGuire
6,440,582 B1 8/2002 McDevitt et al.
6,548,192 B2 * 4/2003 Chen ..... 428/687
7,125,613 B1 * 10/2006 Tullis et al. ..... 428/626
7,244,511 B2 * 7/2007 Choi et al. ..... 428/601

FOREIGN PATENT DOCUMENTS

EP 0 483 810 A2 6/1992
JP 06-170336 6/1994
WO WO 01/27343 A1 4/2001

* cited by examiner

*Primary Examiner*—Dung V Nguyen
(74) *Attorney, Agent, or Firm*—Harold I. Masteller, Jr.

(57) ABSTRACT

The present invention is directed to a method of polishing a minimum spangle aluminum-zinc alloy hot-dip coating applied to sheet steel to provide a polished hot-dip coating having a continuous, consistent surface appearance suitable for use in an unpainted condition.

53 Claims, 2 Drawing Sheets

METHOD FOR POLISHING AND ALUMINUM-ZINC HOT-DIP COATING

FIELD OF THE INVENTION

The present invention is directed to a method and apparatus for manufacturing an embossed metal alloy coated intermediate sheet steel article that provides a continuous consistent surface appearance when the embossed metal alloy coating is finish polished to simulate a stainless steel article; to the embossed intermediate article and the finish polished article manufactured in accordance with the present invention.

It is common practice to grind or brush zinc and zinc alloy hot-dip coatings before a paint coat is applied to the surface of the coated sheet steel substrate. One such past prepaint process example is disclosed in U.S. Pat. No. 4,243,730 to Nakayama, et al. The inventors mechanically remove the metallic coating from one side of the coated steel sheet or strip and apply a finish paint coat to the exposed, bare surface of the steel.

In another example, European Published Application No., 0 483 810 A2, to Konishi, et al. discloses wire brushing a zinc or zinc alloy hot-dip coating before a finish coat of paint is applied to the brushed surface. In this instance, the brushed coating is roughened to enhance both adhesion and the appearance of the paint coat. Neither Nakayama nor Konishi teach using their brushed coatings in an unpainted condition. Moreover, the references actually teach away from such unpainted use in that, on the one hand Nakayama's brushed surface has no corrosion protection absent an applied paint coat, and in the other instance Konishi's unpainted brushed surface has an appearance that is unsuitable for use in finished end products.

Japanese Publication Number 06-170336, to Mori, discloses a galvanized steel article having a "concavo-convex pattern" on the surface of the zinc coating. Similar to Konishi, the crevices of the pattern improve paint adhesion. Such prepaint treatment that includes grinding or sanding is well known in the art because it is difficult to attain good paint adhesion properties on a galvanized surface without first roughening the coating. Mori's preferred paint coating system comprises a silicon based compound, and Mori teaches away from using his concavo-convex patterned coating in an unpainted condition More recently, attempts have been made to produce brushed aluminum-zinc alloy hot-dip coated surfaces that simulate the appearance of stainless steel and are suitable for use in an unpainted condition. U.S. Pat. No. 6,440,582 B1 to McDevitt, et al. discloses brushing a minimized spangle aluminum-zinc alloy coating with 3M Scotch Brite® flap brushes, fiber brushes, or wire brushes to produce a pleasing stainless steel like surface appearance that may be used in an unpainted condition. However, it has been discovered that the brushed article produced in accordance with McDevitt's teaching is problematic in that the brushing process is not able to produce a continuous consistent surface appearance along the length and across the width of the brushed coated steel sheet product, or from coil to coil when multiple coils of coated sheet steel product are brushed. This inconsistency in surface appearance limits McDevitt's brushed product to the manufacture of small, unpainted end products such as mail slots and kickplates used in doors, electrical switchplates, heating system floor and wall registers, etc. Because the appearance of McDevitt's brushed coating varies along the length and across the width of the sheet steel coil, the brushed coated product cannot be used to manufacture large end product articles such as household appliances. This is because the changing surface appearance or surface characteristics are easily noticed in large end products such as decorative building panels, refrigerators, ranges, washers, driers, and the like, and both merchants and their customers view such changing appearance as defective.

SUMMARY OF THE INVENTION

Accordingly, the primary object of the present invention is to provide a method and apparatus for forming an embossed pattern into the metal alloy coating applied to a sheet steel substrate.

It is another object of the present invention to provide an intermediate sheet steel article having an embossed metal alloy coating applied to at least one side thereof.

It is another object of the present invention to provide a metal alloy coating having an embossed pattern that creates a continuous consistent stainless steel like surface appearance when the metal alloy coating is polished.

It is another object of the present invention to provide a method and apparatus for polishing a metal alloy coating having an embossed pattern so that the polished coating has a continuous consistent stainless steel like surface appearance.

It is another object of the present invention to provide a sheet steel article that includes a polished embossed metal alloy coating that provides a continuous consistent stainless steel like appearance in an effective length for the manufacture of large end products.

It is another object of the present invention to provide a sheet steel coil having a polished embossed metal alloy coating along at least one surface thereof, the polished coating having a continuous consistent stainless steel like appearance along the length and across the width of a sheet steel coil.

It is still another object of the present invention to provide sheet steel coils, each coil having a polished embossed metal alloy coating along at least one surface thereof, whereby the polished coating surface is continuous and consistent in appearance from coil to coil.

It is another object of the present invention to provide a metal alloy coated article having a polished metal alloy coating with a continuous consistent stainless steel like surface appearance that is suitable for end product use in an unpainted condition.

Finally, it is another object of the present invention to provide a metal alloy coated article having a polished metal alloy coating with a continuous consistent stainless steel like surface appearance that is suitable for end product use with a top clear coat paint surface or tinted clear coat paint surface.

In satisfaction of the foregoing objects and advantages, the present invention includes a method of embossing and polishing a minimum spangle metal alloy coating applied to a sheet steel substrate. The method provides an intermediate sheet steel article with an embossed coated surface, and a finished polished article having a continuous consistent stainless steel like surface appearance suitable for use in an unpainted condition. The steps of the method include embossing an as-coated metal alloy coating with a textured work roll that imparts a mirror image pattern into the as-coated surface, followed by polishing the embossed surface with at least two polishing belts whereby the polished embossed coating loses 20% or less of as-coated material to achieve the stainless steel like surface appearance.

DETAILED DESCRIPTION OF THE INVENTION

There have been attempts in the past to brush and/or polish metal alloy coatings applied to sheet steel products so that the coating on the carbon steel surface has a stainless steel like appearance that is suitable for use in unpainted end products. One such brushing process is disclosed by McDevitt, et al. in U.S. Pat. No. 6,440,582 B1 granted to on Aug. 27, 2002. The reference discloses brushing a minimized spangle, hot-dip aluminum-zinc alloy coating that is herein referred to as "SLEEK." Brushed SLEEK simulates the visual appearance of stainless steel, and the brushed coating has surface quality suitable for use in the manufacture of unpainted end products. However, it has been discovered that when SLEEK or the like is brushed in accordance with the teaching of the patent, the brushing process fails to produce a continuous consistent surface appearance in long enough lengths for the manufacture of large unpainted end products. Brushed SLEEK has an inconsistent appearance along the length and across the width of the coated sheet steel in the form of longitudinal bands. This makes the brushed product unacceptable for manufacturing large unpainted end products such as architectural panels and household appliances. Therefore, brushed SLEEK, as well as other brushed or polished metal alloy coated sheet steel products, tend to be limited to the manufacture of small, unpainted end products as heretofore mentioned above.

Figure 1:
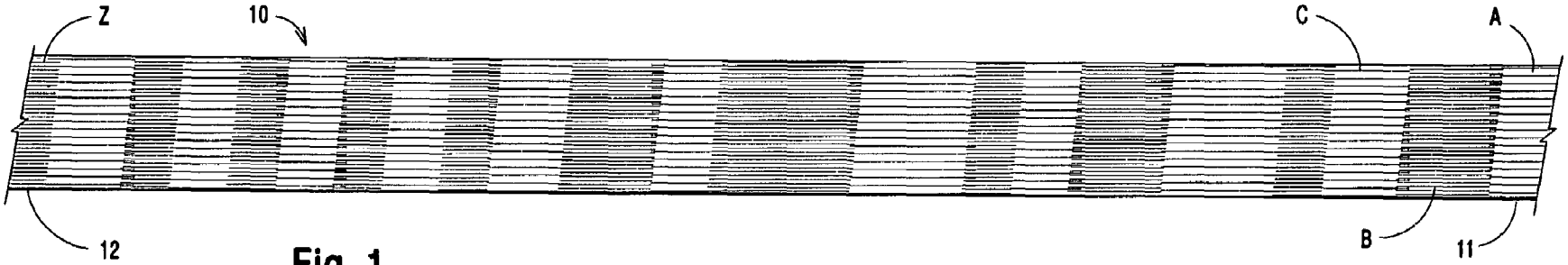
Fig. 1 Prior Art
FIG. 1 is a schematic view labeled Prior Art showing a typical inconsistent surface appearance produced by brushing or polishing methods of the past.

Referring to FIG. 1 labeled Prior Art, the drawing is a schematic representation of a given length of carbon sheet steel 10 with a minimum-spangle aluminum-zinc alloy coating brushed in accordance with the teaching of McDevitt. It should be understood that FIG. 1 is not intended to represent the actual surface appearance of brushed SLEEK. The various portions labeled A through Z along the length of sheet 10 are only schematic representations of the changing surface appearance or characteristics along the length and width of the brushed coating. When metal alloy coatings are brushed or polished, a particular roughness is imparted into the coating surface and the brushed surface highlights defects and/or spangle irregularities present in the coating. In addition, continuous brush wear, changing contact pressure caused by wear on the rotating brush, sheet vibrations, and machine chatter make it difficult to produce a consistent surface appearance in the brushed coating. In actual production operations, it was discovered that these various conditions produce an inconsistent surface appearance along the length and across the width of the metal alloy coated sheet steel as it passes from the entry end to the exit end of a brushing or polishing operation. For example, brushing a coil of hot-dip coated sheet in accordance with prior art teaching produces a series of short length different surface characteristic sections beginning at A, B, and C adjacent the leading end 11 of a coil of coated sheet steel, through to a last different surface appearance labeled Z at the tailing end 12 of the coil. As mentioned above, this continuing series of short different appearing sections A through Z make such brushed hot-dip coatings unsuitable for use in large unpainted end products.

In the description of the preferred and alternate embodiments of the present invention, the term "continuous consistent surface appearance" refers to a consistent surface appearance along the length and across the width of the polished coated steel sheet product and from coil to coil in multiple coils of polished coated sheet steel product. Referring to FIG. 2A, the preferred embodiment of the present invention comprises an embossing operation 20*a* that includes a mill stand 23, and a polishing operation 20*b*, (FIG. 2B) that includes at least two polishing stands, in this instance three polishing stands labeled 1, 2, and 3 respectively. The embossing operation 20*a* is placed at a remote location from the polishing operation 20*b*, and mill stand 23 is adapted to receive an incoming, as-coated sheet steel product and produce an intermediate coated sheet steel article with an embossed coating having surface characteristics that overcome the above mention appearance problems when polished.

Referring specifically to the embossing operation 20*a*, a carbon steel sheet 25, having a metal alloy coating applied thereon, is shown traveling through mill stand 23. Mill stand 23 may be operated in a continuous hot-dip coating line, or alternatively, the mill stand may be operated at a remote location separate from the hot-dip coating line. The preferred coating applied to the incoming carbon steel sheet product 25 is a hot-dip metal alloy coating comprising aluminum in an amount between about 25% and 70% by weight with a preferred aluminum concentration of 55% by weight, a level of silicon, generally about 1.6% by weight, and the balance zinc. In addition, the coating spangle is minimized so that the spangle facet size measures less than 500 microns with a preferred facet size measuring less than 400 microns. It should be mentioned that coating spangle measuring about 400 microns to 300 microns (0.4 mm to 0.3 mm) or smaller is not visible to the naked eye. Such coating spangle can only be seen when viewed under magnification. In the coating industry, a coated product having a spangle size of less than about 400 microns is considered a spangle-free coated product. Accordingly, the preferred incoming coated sheet steel product 25 is spangle free in that it has a spangle facet size measuring between about 200 microns up to about 400 microns, with a preferred spangle facet size measuring 300 microns or less. Any suitable means known in the art may be used to minimize spangle on the incoming coated sheet steel product without departing from the scope of the present invention. One such suitable means for minimizing or reducing spangle facet size is taught by McDevitt, et al. in U.S. Pat. No. 6,440,582 B1, owned by the present assignee, and incorporated herein in its entirety by reference.

The incoming as-coated sheet steel product 25 travels from the entry end of the embossing operation 20*a*, as represented by direction arrow 22, and enters mill stand 23 where a textured pattern is embossed into at least one surface of the aluminum-zinc alloy coating applied to the sheet steel. In the preferred embodiment, mill stand 23 includes a bottom work roll 24 positioned opposite a top work roll 26, and top roll 26 engages the top coated surface of the as-coated steel. The top work roll, hereinafter referred to as textured roll 26, includes a textured or patterned surface 27 along the workface of roll 26. The texture or pattern is applied to the workface by machine grinding, etching, or the like, and the finished workface texture 27 has a transverse roughness (T-$R_a$) ranging between about 2 microns to about 5 microns with a preferred T-$R_a$ range between about 2.3 microns to about 2.8 microns. In FIG. 2A, the textured workface 27 is exaggerated to illustrate schematically, that the finish along the workface of roll 26 is different when compared to the workface of the bottom work roll 24.

An effective amount of roll force within a range between about 10,500 and about 22,000 newtons/cm, is applied by mill stand 23 so that textured embossing roll 26 imprints a mirror image 25*a* of the textured pattern 27 into the metal alloy coating without altering or imprinting the sheet steel substrate portion of coated product 25. The term "mirror image" as used herein, means that the cross-sectional plane of the embossed metal alloy coating is reversed when compared with the cross-sectional plane of the textured embossing roll. In other words, the portions of the textured pattern on the surface of the embossing roll that are viewed as raised are correspondingly indented in the embossed metal alloy coating, and vice-versa. Such use of the term is consistent with *Webster's Ninth New Collegiate Dictionary*, defining mirror image as "something that has its parts reversely arranged in comparison with another similar thing or that is reversed with reference to an intervening axis or plane."

The effective amount of roll force required to emboss the metal alloy coating will vary depending on the coating alloy, coating thickness, and the grade of the sheet steel. Embossing the as-coated metal alloy surface is significant because the force generated by work rolls 24 and 26 causes plastic deformation in the metal alloy coating and presses or causes the coating to flow into the textured pattern 27 of roll 26. This embossing operation produces an intermediate sheet steel product with a mirror image 25*a* of the textured roll 26 without loss of coating material. In other words, the coating weight of the embossed intermediate sheet steel product is identical to the coating weight on the incoming as-coated sheet steel product. It is possible that there might be insignificant coating weight change due to the slight elongation, between about 0.25% and about 1.0% of the sheet steel product during embossing. However, such an insignificant amount of coating loss would have no adverse effect on corrosion protection. This is a significant difference when compared to other brushing or polishing operations where, prior to final polishing, the as-coated surface is pretreated by grinding, etching, or the like. Such pretreatment practices remove coating material before final polishing of the metal alloy coating and significantly reduces corrosion protection in the finished polished product.

In other polishing operations, when a metal alloy coating is polished to simulate the appearance of stainless steel, as much as 50% of the coating thickness is removed before the stainless steel like appearance is produced. Building on this knowledge, any pretreatment operation, for example grinding, that removes as-coated material in an amount "X" will greatly reduce corrosion resistance in the finished polished product. In such an instance, pretreatment grinding in combination with finish polishing reduces the metal alloy coating thickness by as much as 50%+X. The embossing operation of the present invention does not remove metal alloy material from the as-coated surface of the sheet steel product, and the embossed coating surface enables polishing to a stainless steel like appearance with a loss of as-coated thickness of 20% or less. Accordingly, the finished polished article comprises 80% or more of the original protective metal alloy coating that was applied to the sheet steel article before embossing and polishing. This is an unexpected and a significant improvement in corrosion protection when compared to the prior art and current teaching within the industry.

In addition, improving corrosion resistance in the metal alloy coated sheet steel product, the embossing operation creates a textured or patterned coating 25*a* foundation that masks non-uniform surface imperfections in the as-coated metal alloy surface on the sheet steel substrate. This foundation enables the polishing operation to bring out a continuous consistent surface appearance in the final polished coating. Without the embossed pattern 25*a*, the polishing operation can only produce a continuous stainless steel like appearance after about 50% or more of the coating thickness is removed. If the polishing operation removes less than 50% of the coating, the resulting non-embossed polished coating will likely encounter the above mentioned problems associated with the McDevitt brushing process.

Figure 2B:
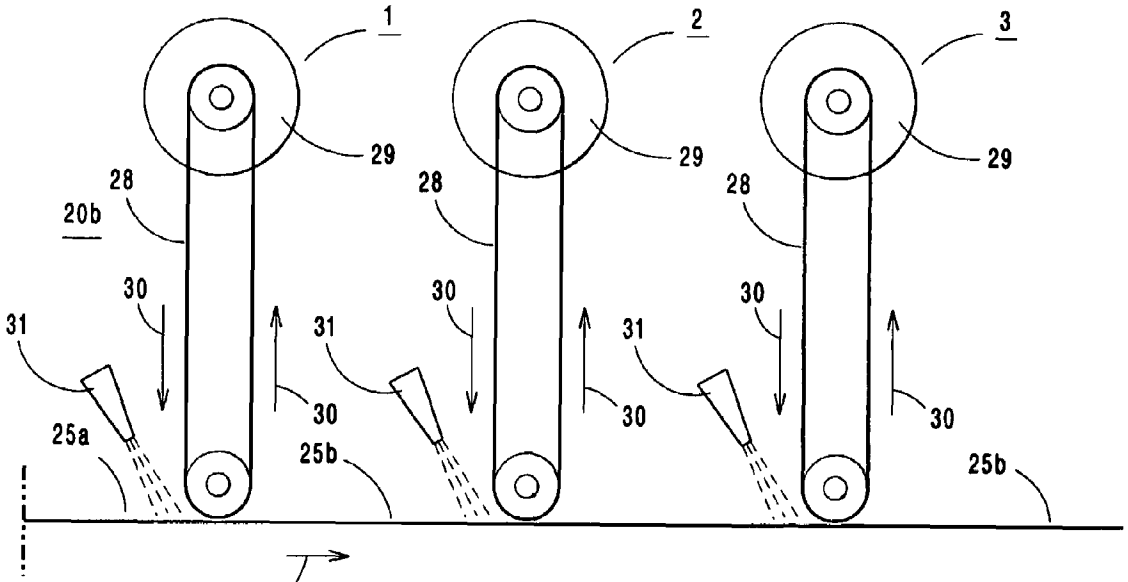
FIG. 2B is a schematic view showing the preferred polishing operation of the present invention.
Figure 2A:
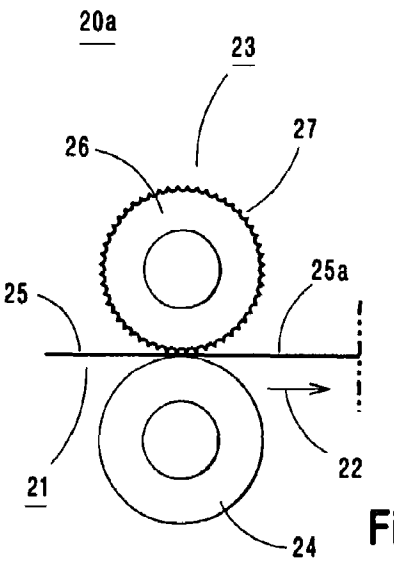
FIG. 2A is a schematic view showing the preferred embossing operation of the present invention.

The polishing operation 20*b* may be located on site with the embossing mill stand 23, or as shown in FIG. 2B, it may be placed at a remote location separate from the embossing mill stand 23. In either instance, the polishing operation 20*b* builds on the foundation provided by the embossed intermediate coated product. The polished embossed surface characteristics produce a finished coated product that has a continuous consistent stainless steel like surface appearance. The continuous consistent appearance extends along the length, and across the width, of a polished coil of coated carbon sheet steel. The stainless steel like appearance is also continuous and consistent from coil to coil when multiple coils of embossed intermediate sheet steel product are polished.

A random sampling of the embossed intermediate coated steel product was measured to determine the surface characteristic values of the embossed coating. Table A lists the surface values for samples A through I, where the characteristics are defined by longitudinal waviness (L-$W_{ca}$) and transverse waviness (T-$W_{ca}$), longitudinal roughness (L-$R_a$) and transverse roughness (T-$R_a$), and longitudinal peak count (L-PC) and transverse peak count (T-PC).

TABLE A

EMBOSSED INTERMEDIATE COATED PRODUCT

| | Waviness (Microns) | | Roughness (Microns) | | Peak Count (Centimeters) | |
|---|---|---|---|---|---|---|
| Sample | L-$W_{ca}$ | T-$W_{ca}$ | L-$R_a$ | T-$R_a$ | L-PC | T-PC |
| A | 0.56 | 1.09 | 0.57 | 1.09 | 72.4 | 97.2 |
| B | 0.59 | 1.08 | 0.58 | 1.10 | 67.3 | 89.8 |
| C | 0.68 | 1.08 | 0.61 | 1.10 | 50.0 | 84.6 |
| D | 0.68 | 0.76 | 0.61 | 1.04 | 32.5 | 85.0 |
| E | 0.69 | 0.76 | 0.61 | 1.04 | 30.0 | 92.5 |
| F | 0.69 | 0.77 | 0.62 | 1.04 | 30.0 | 97.2 |
| G | 0.58 | 0.98 | 0.70 | 1.30 | 57.5 | 85.0 |
| H | 0.61 | 0.99 | 0.70 | 1.28 | 44.9 | 92.5 |
| I | 0.52 | 0.99 | 0.67 | 1.29 | 54.7 | 92.5 |
| Average | 0.62 | 0.94 | 0.63 | 1.14 | 48.8 | 90.6 |
| Standard Deviation | 0.06 | 0.14 | 0.05 | 0.11 | 15.8 | 5.00 |

In consideration of the measured surface characteristics, the embossed coating on the intermediate coated sheet steel product 25*a* has a L-$W_{ca}$ ranging from about 0.50 microns to about 0.70 microns with an aim or target L-$W_{ca}$ of about 0.64 microns. The embossed coating also has a T-$W_{ca}$ in a range of about 0.76 microns up to about 1.10 microns with a target T-$W_{ca}$ of about 0.94 microns. With respect to surface roughness, the L-$R_a$ of the embossed coating is between about 0.56 microns and about 0.71 microns with a target L-$R_a$ of about 0.64 microns. The T-$R_a$ ranges between about 1.00 microns and about 1.30 microns with a target T-$R_a$ of about 1.14 microns. Finally, the embossed coated surface has a L-PC that ranges between about 32 peaks to about 72 peaks per centimeter with a 49 peaks/cm target, and a T-PC range of about 85 and about 97 peaks/cm with a target T-PC of about 90 peaks/cm.

Referring to FIG. 2B, the embossed intermediate coated sheet steel product 25*a* enters the polishing operation or polishing station 20*b* where a first polishing stand 1, a second polishing stand 2, and a third polishing stand 3 are spaced apart along station 20*b*. Each polishing stand 1 through 3 includes a continuous polishing belt 28 attached to a variable speed drive 29, and each drive 29 rotates its respective belt in a direction parallel to, or corresponding with, the pass or travel direction of the incoming embossed intermediate sheet steel product 25*a*. The directions of travel are represented by the belt travel arrows 30, and by the sheet travel arrow 22. The polishing belts 28 comprise a 120 grit material or finer. The polishing belt grit can range between about 320 up to about 120 grit with a preferred 180 grit material. It should be understood that any suitable abrasive grit material may be used as a polishing medium without departing from the scope of the present invention. For example, a silicon-carbide grit, aluminum oxide grit, zirconia alumina grit, ceramic grain grit material, or the like may be applied to the polishing surface of belts 28. However, one should be expected that depending upon the particular polishing grit, the finish surface quality characteristics of the final polished coating will vary with respect to the grit material selection. Accordingly, the selection of a polishing grit for belts 28 may change depending upon product quality demands in combination with belt cost and belt service life.

Variable speed drives 29 are individually adjusted so that the polishing belts 28 run at a speed that is faster than the incoming sheet steel line speed. The incoming embossed intermediate coated sheet steel product 25*a* travels at a line speed between about 75 feet (22.86 meters) to about 200 feet (60.96 meters) per minute (fpm). We have discovered that the belt speed that provides the desired continuous consistent surface characteristics, that simulates stainless steel like appearance, is greater than 1500 surface feet per minute (SFPM) or 457.2 surface meters per minute (SMPM). Accordingly, a desired belt speed range is between 1500 SFPM (457.2 SMPM) up to about 4000 SFPM (1219.2 SMPM), with a preferred belt speed range between 1800 SFPM (548.64 SMPM) up to 3400 SFPM (1036.32 SMPM). In addition, it has been discovered that the line of polishing belts should run at individually adjusted different belt speeds to avoid chatter marks on the polished surface.

A flushing lubricant 31, and in particular, a water based flushing lubricant, floods polishing stands 1, 2, and 3 so that polishing debris, for example metallic coating fines, are flushed from polished surface 25*b*. Failure to remove such metallic fines from the sheet steel surface will cause galling and/or metal pickup in the polishing belts 28. This produces longitudinal banding along the polished surface of the coil length.

The above preferred apparatus and method produces a continuous consistent stainless steel like surface appearance along the entire length and across the full width of the embossed and polished sheet steel product. The preferred finish sheet steel product 25*b* comprises an intermediate sheet steel product having a spangle free, embossed hot-dip aluminum-zinc alloy coating along at least one surface thereof, the embossed coated surface polished to a stainless steel like surface appearance. A sampling of the embossed/polished spangle free coating 25*b* was measured to determine its surface characteristics. Table B lists the measured surface characteristic values for samples A through I corresponding with above Table A.

Referring specifically to Table B, the embossed/polished coating 25*b* has a L-$W_{ca}$ range between about 0.67 microns to about 1.43 microns with a preferred L-$W_{ca}$ ranging between about 0.70 microns to about 0.80 microns and a target of about 0.75 microns. The T-$W_{ca}$ ranges between about 0.40 microns up to about 0.50 microns, with a preferred T-$W_{ca}$ between about 0.40 microns up to about 0.46 microns and a target of about 0.44 microns. The L-$R_a$ along the polished embossed coating ranges between about 0.6 microns up to about 1.0 microns with a preferred L-$R_a$ between about 0.7 microns and about 0.9 microns with a target of about 0.76 microns. The T-$R_a$ ranges between about 1.4 microns and about 1.8 microns, with a preferred T-$R_a$ range between about 1.5 microns and about 1.7 microns with a target of about 1.58 microns. The L-PC of the polished embossed coating has a range between about 20 peaks to about 37 peaks/cm with a preferred L-PC range of about 24 to about 32 peaks/cm and a target of about 25.8 peaks/cm. The T-PC range is about 177 and about 221 peaks/cm with a preferred T-PC range between about 189 to about 209 peaks/cm and a target of about 204 peaks/cm.

TABLE B

| | EMBOSSED/POLISHED COATING | | | | | |
|---|---|---|---|---|---|---|
| | Waviness (Microns) | | Roughness (Microns) | | Peak Count (Centimeters) | |
| Sample | L-$W_{ca}$ | T-$W_{ca}$ | L-$R_a$ | T-$R_a$ | L-PC | T-PC |
| A | 0.68 | 0.45 | 0.67 | 1.70 | 30.0 | 200 |
| B | 0.67 | 0.45 | 0.68 | 1.70 | 37.5 | 202 |
| C | 0.67 | 0.44 | 0.67 | 1.71 | 32.5 | 205 |
| D | 0.89 | 0.41 | 0.71 | 1.55 | 27.5 | 210 |
| E | 0.82 | 0.40 | 0.69 | 1.54 | 20.0 | 212 |
| F | 0.86 | 0.41 | 0.69 | 1.54 | 30.0 | 207 |
| G | 1.38 | 0.46 | 0.99 | 1.50 | 20.0 | 200 |
| H | 1.37 | 0.46 | 0.98 | 1.50 | 17.5 | 205 |
| I | 1.43 | 0.46 | 0.99 | 1.50 | 17.5 | 190 |
| Average | 0.97 | 0.44 | 0.76 | 1.58 | 25.8 | 204 |
| Standard Deviation | 0.33 | 0.03 | 0.15 | 0.09 | 7.28 | 6.61 |

In addition to the above Table A and Table B surface measurements, a series of twenty-four polishing tests were conducted over an extended period of time to develop the desired stainless steel like product under actual production operations. Referring to FIGS. 2A and 2B, one of the successful tests that produced the desired continuous consistent stainless steel like surface appearance from end to end and across the width of the as-coated sheet steel product was polished using the following exemplary test parameters. The top surface 25 of the incoming as-coated sheet 21 was embossed between the work rolls 24 and 26 of a skin mill 23 with the top work roll 26 having a textured workface 27. The embossed intermediate coated sheet steel product traveled from the embossing operation 20*a* to the polishing operation 20*b* where belt motors were individually adjusted to selectively tune each polishing belt to a speed of between about 800 up to about 3400 SFPM. The embossed surface 25*b* of the incoming intermediate sheet steel product engaged the rotating polishing belts at a line speed of 140 fpm with polishing stand 2 placed in a standby condition during the polishing operation. Such a belt standby condition facilities rapid belt changes if one of the on-line belts 1 or 3 needs to be replaced due to unexpected damage, wear, or metal pickup as described above. Inspection of the polished test sheet surface exhibited the desired surface appearance and it was determined that the embossed aluminum-zinc alloy coating thickness, after finish polishing, measured between 0.58 to 0.66 mils. The as-coated thickness measured between about 0.73 mils and 0.83 mils. Accordingly, about 20% of the as-coated surface or between about 0.14 to about 0.17 mils of original metal alloy coating material was lost during polishing to a stainless steel like appearance. To state it differently, the finished polished sheet steel article comprised 80% or more of the original coating thickness in the polished surface.

The amount of coating material removed or lost from the embossed intermediate coated surface is very significant when compared to other polishing operations that remove up to 50% of the as-coated metal alloy coating during polishing. As heretofore mentioned above, in the present invention does not remove protective as-coated material from the steel sheet substrate during the embossing, and the embossed texture or pattern provides a foundation that the polishing operation builds on so that only 20% or less of the as-coated weight is lost during polishing to the desired surface characteristics defined above. Therefore, the present embossed/polished metal alloy coated sheet steel product has a heretofore-unavailable continuous consistent stainless steel like finish with improved corrosion resistance or protection.

Figure 3:
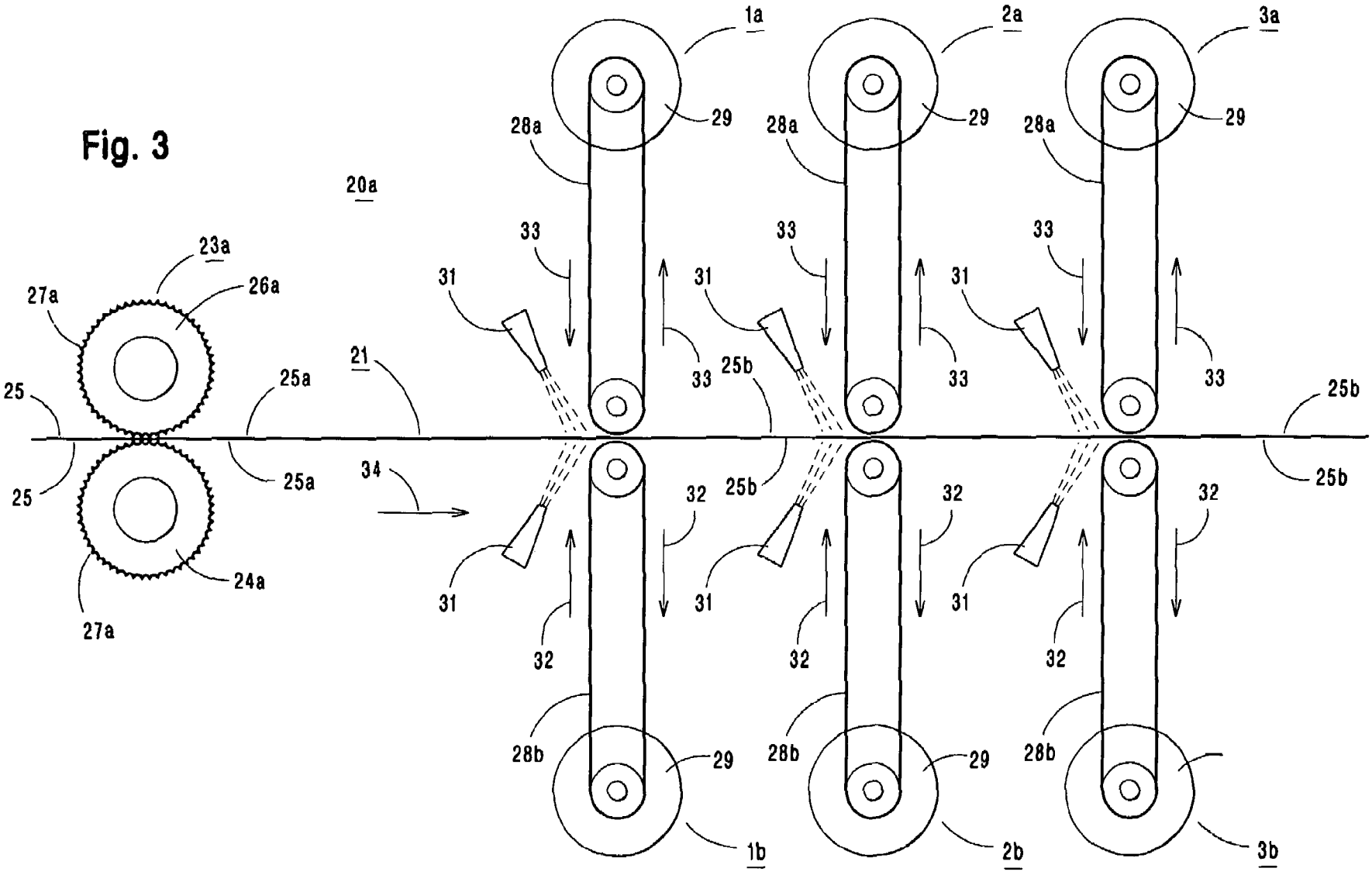
FIG. 3 is a schematic view showing alternate embodiment of the present invention.

Referring to FIG. 3, an alternate embodiment is shown comprising a combination embossing operation 20*a* and a polishing 20*b* positioned at different locations along a continuous production line. In this instance, the polishing operation 20*a* includes a mill stand 23*a* with a bottom work roll 24*a* top work roll 26*a* having a textured workface 27*a*. The as-coated sheet steel enters a mill stand 23*a* and both coated surfaces 25 are embossed as the sheet steel product passes between the textured work rolls. The textured workface 27*a* on each roll 24*a* and 26*a* embosses mirror image surface characteristics into the as-coated surfaces via plastic deformation as described above, so that substantially no coating material 25 is lost or removed from the metal alloy coating applied to the sheet steel substrate. This provides an intermediate carbon steel sheet product having an embossed coating 25*a* on both sides of the steel sheet.

Similar to the above preferred embodiment, the embossed intermediate sheet steel product 25*a* enters the polishing operation 20*b* where a first set of top and bottom polishing stands 1*a* and 1*b*, a second set of top and bottom polishing stands 2*a* and 2*b*, and a third set of top and bottom polishing stands 3*a* and 3*b* are spaced apart along the polishing operation. Each top and bottom polishing stand includes a continuous polishing belt 28*a* and a variable speed drive 29 operated as described above in the preferred embodiment. However, in this instance, polishing belts 28*b* in bottom polishing stands 1*b*, 2*b*, and 3*b* are rotated in an opposite direction (arrow 32), as compared to belts 28*a* in the top polishing stands 1*a*, 2*a*, and 3*a* (arrow 33). As a result, all the polishing belts (28*a* and 28*b*) rotate in a direction parallel to the pass direction or travel direction of the incoming embossed intermediate sheet steel product (arrow 34).

A flushing lubricant 31 is provided at each polishing stand so that residual metallic fines are washed from both polished surfaces 25*b* to insure a continuous consistent surface appearance is provided along both the top and bottom surfaces of the polished embossed intermediate sheet steel product. After final polishing, both surfaces exhibit the desired surface characteristics with only a 20% or less loss of the as-coated metal alloy material applied to the pre-embossed metal alloy coated sheet steel article. In other words, the finished polished article contains 80% or more of the original protective metal alloy coating applied to the sheet steel article before embossing or polishing.

Even though the preferred metal alloy coating on the as-coated sheet steel product is a spangle free aluminum-zinc alloy hot-dip coating, for example SLEEK, it is expected that other protective corrosion resistant coating applied to carbon sheet steel products may be embossed and polished in accordance with the above method and apparatus without departing from the scope of the present invention. Such corrosion resistant coatings include, for example, plated coatings such electrogalvanized sheet steel product, nickel-zinc coatings, galvanized coatings, aluminized coatings, or the like.

In addition, even though the metal alloy coating polished in accordance with the present invention is intended for use in an unpainted condition, it should be understood that the polished end product is suitable for use with a top clear coat paint surface or with a top tinted clear coat paint surface.

As such, an invention has been disclosed in terms of preferred embodiments and alternate embodiments thereof, which fulfills each one of the objects of the present invention as set forth above and provides a new embossed/polished metal alloy coated product suitable for use in large unpainted end products. Of course, various changes, modifications, and alterations from the teachings of the present invention may be contemplated by those skilled in the art without departing from the intended spirit and scope thereof. It is intended that the present invention only be limited by the terms of the appended claims.

We claim:

1. A method for polishing a hot-dip aluminum zinc alloy coated sheet steel article to produce a polished coated surface having a continuous and consistent stainless steel like appearance, the steps of the method comprising:

a) providing a sheet steel substrate with a hot-dip aluminum zinc alloy coating applied thereto, the hot-dip aluminum zinc alloy coating having a spangle facet size less than about 500 microns;

b) embossing said hot-dip aluminum zinc alloy coating with at least one textured roll, said at least one textured roll applying an effective roll force that embosses said hot-dip aluminum zinc alloy coating without embossing the sheet steel substrate; and c) polishing said embossed hot-dip aluminum zinc alloy coating, the polished embossed coating having said continuous and consistent stainless steel like appearance.

2. The method recited in claim 1, wherein said at least one textured roll has a textured workface, and the method further includes: imprinting a mirror image of said textured workface into the hot-dip alloy coating without imprinting the sheet steel substrate.

3. The method recited in claim 1, wherein said applied effective roll force is less than about 22,000 newtons/cm.

4. The method recited in claim 1, wherein said applied effective roll force is between about 10,500 and about 22,000 newtons/cm.

5. The method recited in claim 2, wherein said textured workface has a T-$R_a$ between about 2 microns and about 5 microns.

6. The method recited in claim 2, wherein said textured workface has a T-$R_a$ between about 2.3 microns and about 2.8 microns.

7. The method recited in claim 2, wherein said mirror image has a L-$W_{ca}$ between about 0.50 microns and 0.70 microns, and a T-$W_{ca}$ between about 0.76 microns and about 1.10 microns.

8. The method recited in claim 2, wherein said mirror image has a L-$W_{ca}$ of about 0.64 microns and a T-$W_{ca}$ of about 0.94 microns.

9. The method recited in claim 2, wherein said mirror image has a L-$R_a$ between about 0.56 microns and about 0.71 microns and a T-$R_a$ between about 1.00 microns and about 1.30 microns.

10. The method recited in claim 2, wherein said mirror image has a L-$R_a$ of about 0.64 microns and a T-$R_a$ of about 1.14 microns.

11. The method recited in claim 2, wherein said mirror image has a L-PC between about 32 peaks per/cm and about 72 peaks per/cm and a T-PC between about 85 and about 97 peaks/cm.

12. The method recited in claim 2, wherein said mirror image has a L-PC of about 49 peaks/cm and a T-PC of about 90 peaks/cm.

13. The method recited in claim 1, wherein the hot-dip aluminum zinc alloy coated sheet steel article has an as-coated thickness between about 0.73 mils and 0.83 mils and said embossed hot-dip aluminum zinc alloy coating has a thickness between about 0.73 mils and 0.83 mils.

14. The method recited in claim 1, wherein said polishing step further comprises: polishing said embossed hot-dip aluminum zinc alloy coating with at least two rotating abrasive belts, said abrasive belts rotating at a belt speed greater than 1500 SFPM, said abrasive belts rotating at different respective belt speeds.

15. The method recited in claim 14, wherein said abrasive belts rotate at a different respective belt speeds between about 1500 SFPM and about 4000 SFPM.

16. The method recited in claim 14, wherein said abrasive belts rotate at a different respective belt speeds between about 1800 SFPM and about 3400 SFPM.

17. The method recited in claim 14, wherein said at least two abrasive belts comprise a polishing surface of 120 grit or finer.

18. The method recited in claim 14, wherein said abrasive belts comprise between about 320 grit and about 120 grit polishing material.

19. The method recited in claim 14, wherein said abrasive belts comprise a 180 grit polishing material.

20. The method recited in claim 14, wherein said polishing step further comprises: flushing said embossed hot-dip aluminum zinc alloy coating surface with a lubricant.

21. The method recited in claim 20, wherein said lubricant is water based.

22. The method recited in claim 1, wherein said polished embossed hot-dip aluminum zinc alloy coating has a L-$W_{ca}$ between about 0.67 microns and about 1.43 microns and a T-$W_{ca}$ between about 0.40 microns and about 0.50 microns.

23. The method recited in claim 1, wherein said polished embossed hot-dip aluminum zinc alloy coating has a L-$W_{ca}$ between about 0.70 microns and about 0.80 microns and a T-$W_{ca}$ between about 0.40 microns and about 0.46 microns.

24. The method recited in claim 1, wherein said polished embossed hot-dip aluminum zinc alloy coating has a L-$W_{ca}$ of about 0.75 microns and a T-$W_{ca}$ of about 0.44 microns.

25. The method recited in claim 1, wherein said polished embossed hot-dip aluminum zinc alloy coating has a L-$R_a$ between about 0.60 microns and to about 1.00 microns and a T-$R_a$ between about 1.40 microns and about 1.80 microns.

26. The method recited in claim 1, wherein said polished embossed hot-dip aluminum zinc alloy coating has a L-R hd a between about 0.70 microns and about 0.90 microns and a T-$R_a$ between about 1.50 microns and about 1.70 microns.

27. The method recited in claim 1, wherein said polished embossed hot-dip aluminum zinc alloy coating has a L-$R_a$ of about 0.76 microns and a T-$R_a$ of about 1.58 microns.

28. The method recited in claim 1, wherein said polished embossed hot-dip aluminum zinc alloy coating has a L-PC between about between about 20 peaks/cm and about 37 peaks/cm and a T-PC between about 177 peaks/cm and about 221 peaks/cm.

29. The method recited in claim 1, wherein said polished embossed hot-dip aluminum zinc alloy coating has a L-PC between about 24 peaks/cm and about 32 peaks/cm and a T-PC between about 189 peaks/cm and about 209 peaks/cm.

30. The method recited in claim 1, wherein said polished embossed hot-dip aluminum zinc alloy coating has a L-PC of about 25.8 peaks/cm and a T-PC of about 204 peaks/cm.

31. The method recited in claim 1, wherein said hot-dip aluminum zinc alloy coating comprises: a minimum spangle hot-dip aluminum-zinc alloy coating containing between about 25% and 70% aluminum by weight.

32. The method recited in claim 1, wherein said hot-dip aluminum zinc alloy coating comprises: a minimum spangle aluminum-zinc alloy hot-dip coating containing about 55% aluminum by weight.

33. The method recited in claim 1, wherein said minimized spangle aluminum zinc hot-dip coating has a facet size between about 200 microns and about 500 microns.

34. The method recited in claim 1, wherein said minimized spangle aluminum zinc hot-dip coating having a facet size is less than about 300 microns.

35. The method recited in claim 1, wherein said hot-dip aluminum-zinc alloy coating is spangle free.

36. A method for producing an embossed sheet steel article that simulates a stainless steel surface when polished from a sheet steel substrate having an aluminum-zinc alloy hot-dip coating applied thereto, said aluminum-zinc alloy hot-dip coating having a minimized spangle facet size less than about 500 microns, the steps of the method comprising:

passing the aluminum-zinc alloy hot-dip coated sheet steel substrate between work rolls, at least one work roll having a textured workface; and applying an effective roll force that embosses a mirror image of said textured workface into said aluminum-zinc alloy hot-dip coating without embossing said sheet steel substrate, said mirror image having surface characteristics that produce said continuous consistent stainless steel like appearance when said embossed aluminum-zinc alloy hot-dip coating is polished.

37. The method recited in claim 36, wherein said applied effective roll force is between about 10,500 and about 22,000 newtons/cm.

38. The method recited in claim 36, wherein said textured workface has a T-$R_a$ between about 2 microns and about 5 microns.

39. The method recited in claim 36, wherein said textured workface has a T-$R_a$ between about 2.3 microns and about 2.8 microns.

40. The method recited in claim 36, wherein said imprinted mirror image has a L-$W_{ca}$ between about 0.50 microns and 0.70 microns, and a T-$W_{ca}$ between about 0.76 microns and about 1.10 microns.

41. The method recited in claim 36, wherein said imprinted mirror image has a L-$W_{ca}$ of about 0.64 microns and a T-$W_{ca}$ of about 0.94 microns.

42. The method recited in claim 36, wherein said imprinted mirror image has a L-$R_a$ between about 0.56 microns and about 0.71 microns and a T-$R_a$ between about 1.00 microns and about 1.30 microns.

43. The method recited in claim 36, wherein said imprinted mirror image has a L-$R_a$ of about 0.64 microns and a T-$R_a$ of about 1.14 microns.

44. The method recited in claim 36, wherein said imprinted mirror image has a L-PC between about 32 peaks per/cm and about 72 peaks per/cm and a T-PC between about 85 and about 97 peaks/cm.

45. The method recited in claim 36, wherein said imprinted mirror image has a L-PC of about 49 peaks/cm and a T-PC of about 90 peaks/cm.

46. The method recited in claim 36, wherein the coated sheet steel article has an as-coated thickness between about 0.73 mils and 0.83 mils and said embossed coated sheet steel article has a coating thickness between about 0.73 mils and 0.83 mils.

47. The method recited in claim 36, wherein said embossed hot-dip coating has a thickness between about 0.73 mils and 0.83 mils.

48. The method recited in claim 36, wherein said aluminum-zinc alloy hot-dip coating contains between about 25% and about 70% aluminum by weight.

49. The method recited in claim 36, wherein said aluminum-zinc alloy hot-dip coating contains about 55% aluminum by weight.

50. The method recited in claim 36, wherein said aluminum-zinc alloy hot-dip coating has a spangle facet size between about 200 microns and about 500 microns.

51. The method recited in claim 36, wherein said aluminum-zinc alloy hot-dip coating has a spangle facet size less than about 300 microns.

52. The method recited in claim 36, wherein said aluminum-zinc alloy hot-dip alloy coating is spangle free.

53. A method for simulating a stainless steel appearance along the surface of a hot-dip coated sheet steel article, the steps of the method comprising:

providing a zinc alloy hot-dip coated sheet steel substrate, the zinc alloy hot-dip coating having a spangle facet size less than about 500 microns;

embossing at least one surface of said zinc alloy hot-dip coating without embossing said sheet steel substrate; and polishing said at least one embossed zinc alloy hot-dip coated surface with at least two rotating abrasive belts, said polished surface providing said simulated stainless steel surface.

* * * * *